US011149915B2

(12) United States Patent
Drummond et al.

(10) Patent No.: US 11,149,915 B2
(45) Date of Patent: Oct. 19, 2021

(54) SELF-LEVELING LAMP SHADE

(71) Applicants: Scott Drummond, Tuscaloosa, AL (US); Mark Manning, Tuscaloosa, AL (US)

(72) Inventors: Scott Drummond, Tuscaloosa, AL (US); Mark Manning, Tuscaloosa, AL (US)

( * ) Notice: Subject to any disclaimer, the term of this patent is extended or adjusted under 35 U.S.C. 154(b) by 0 days.

(21) Appl. No.: 17/182,646

(22) Filed: Feb. 23, 2021

(65) Prior Publication Data

US 2021/0285617 A1 Sep. 16, 2021

Related U.S. Application Data

(60) Provisional application No. 62/988,430, filed on Mar. 12, 2020.

(51) Int. Cl.

| | |
|---|---|
| ***F21V 1/08*** | (2006.01) |
| ***F21V 17/12*** | (2006.01) |
| ***F21V 17/02*** | (2006.01) |
| ***F21V 1/02*** | (2006.01) |
| ***F21V 1/00*** | (2006.01) |

(52) U.S. Cl.

CPC ..... *F21V 1/08* (2013.01); *F21V 1/00* (2013.01); *F21V 1/02* (2013.01); *F21V 17/02* (2013.01); *F21V 17/12* (2013.01)

(58) Field of Classification Search

CPC ... F21V 1/08; F21V 1/02; F21V 17/02; F21V 17/12; F21V 1/00

USPC ..... 362/322, 351, 355, 356, 357, 358

See application file for complete search history.

(56) References Cited

U.S. PATENT DOCUMENTS

| | | | | | |
|---|---|---|---|---|---|
| 2,808,503 | A * | 10/1957 | Ball | F21V 17/00 | 362/452 |
| 4,414,618 | A * | 11/1983 | Jacobson | F21V 17/12 | 362/282 |
| 5,392,204 | A * | 2/1995 | Schumaker | F21S 6/002 | 362/294 |
| 7,008,083 | B2 * | 3/2006 | Leddusire | F21V 1/08 | 362/351 |
| 8,142,055 | B2 * | 3/2012 | Dorr | F21V 17/02 | 362/322 |
| 2008/0186715 | A1 * | 8/2008 | Adams | F21V 17/102 | 362/310 |
| 2013/0067713 | A1 | 3/2013 | Myer | | |

* cited by examiner

*Primary Examiner* — Lau K Tso

(74) *Attorney, Agent, or Firm* — Schwegman Lundberg & Woessner, P.A.

(57) ABSTRACT

A leveling system for a lamp shade can include a bearing, a stud extension, and a weight. The bearing can be positionable around a stud of a lamp shade assembly and can be configured to be supported by a bracket of the lamp shade assembly. The bearing can define a bearing surface engageable with a hub of the lamp shade to provide an articulation surface for the hub. The weight can be releasably securable to a spoke of the lamp shade and can be positionable on the spoke to level the lamp shade about the bearing with respect to a plane.

20 Claims, 8 Drawing Sheets

SELF-LEVELING LAMP SHADE

CLAIM OF PRIORITY

This patent application claims the benefit of priority, under 35 U.S.C. Section 119(e), to Scott Drummond, U.S. Patent Application Ser. No. 62/988,430, entitled "SELF-LEVELING LAMP SHADE," filed on Mar. 12, 2020, which is hereby incorporated by reference herein in its entirety.

BACKGROUND

Lamps are used all over the world to provide light in indoor and outdoor settings. Indoor lamps often include a base, a lightbulb, and a lamp shade to act as a diffuser to reduce light intensity of the light bulb within a room. Many lamp shades connect to the base of the lamp using a harp supporting a threaded stud or post configured to support a hub of the lamp shade. Many lamps include one or more spokes connecting the hub to a frame of the shade, which can support a covering of the lamp shade.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Many lamps include one or more spokes connecting the hub to a frame of the shade, which can support a covering of the lamp shade. The hub can engage a bracket supported by a base of the lamp to provide a relatively level surface for the hub. However, various issues can cause the hub (or spokes connected thereto or the shade) to be out of level. For example, the harp can become bent, the bracket can have a non-planar mounting surface, the bracket can be bent, the hub can be non-planar, or the spokes can be crooked (non-linear).

This disclosure can help to address these issues by providing a kit to help balance or level the lamp shade with respect to the base. For example, a bearing can be installed that allows the lamp shade to articulate with respect to the base so that a desired orientation of the lamp shade can be achieved. A stud extension can also be provided for securing a finial to the stud of a bracket of the lamp to fix the lamp shade in the desired position.

The above discussion is intended to provide an overview of subject matter of the present patent application. It is not intended to provide an exclusive or exhaustive explanation of the invention. The description below is included to provide further information about the present patent application.

Figure 1:
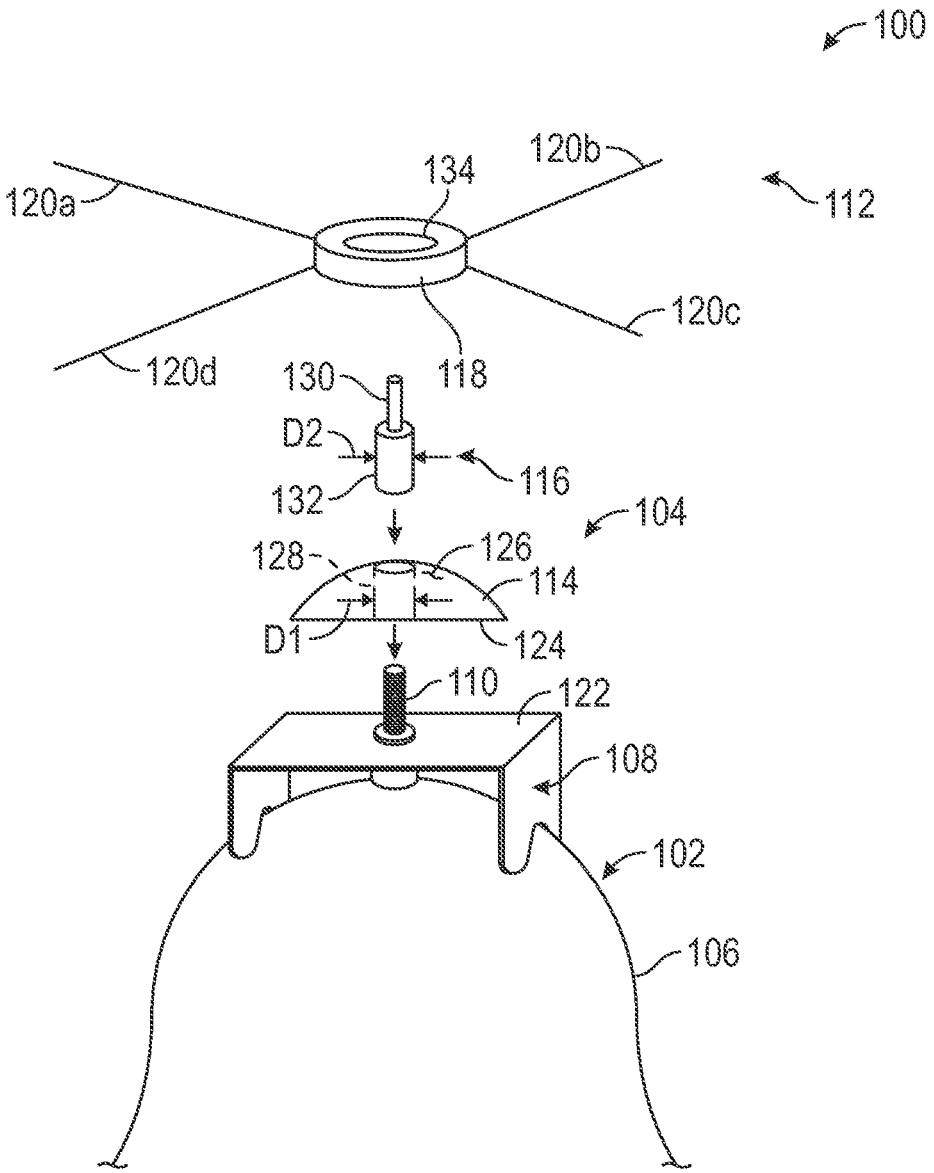
FIG. 1 illustrates a front view of a lamp shade leveling assembly.

FIG. 1 illustrates a front view of a lamp shade leveling assembly 100, in accordance with at least one example of this disclosure. The assembly 100 can include components of a lamp 102 and a leveling kit 104. The lamp 102 can include a harp or shade support 106, a bracket 108, a stud 110, and a shade hub, fitter, or fitting 112. The kit 104 can include a bearing 114 and a stud extension 116. The fitter 112 can include a hub 118, and spokes 120*a*-120*d*. The bracket 108 can include a mounting surface 122. The bearing 114 can include a flat surface 124, a bearing surface 126, and a bearing bore 128. The stud extension 116 can include a male portion 130 and a female portion 132. Also shown in FIG. 1 are orientation indicators Top and Bottom.

The components of the leveling assembly 100 can be made of materials such as one or more of metals, plastics, foams, elastomers, ceramics, composites, combinations thereof, or the like. Materials of some components are discussed in further detail below.

The harp or shade support 106 can be a rigid or semi-rigid member that can be a support or bracket connected to a base of a lamp. The harp 106 can be configured to support the bracket 108 at a top portion of the harp 106. The bracket 108 can be connected to the harp 106 at one or more locations. The mounting surface 122 of the bracket 108 can be a substantially planar surface for supporting one or more components of the assembly 100.

The stud 110 can be a fastening member secured to the bracket 108 or the harp 106. The stud 110 can extend upward from the bracket 108, such as from the mounting surface 122. The stud 110 can be configured to pass through the hub 118 to allow the hub 118 to rest on the bracket 108 such that the fitter 112 (and the lamp shade) are supported by the bracket 108 and therefore by the harp 106 and a base of the lamp. The stud 110 can be a threaded member configured to threadably engage another component, such as a finial, to capture the hub between the finial and the bracket 108 to secure the hub 118 to the bracket 108.

The hub 118 can generally be a central portion of the fitter 112 to which the spokes 120*a*-120*d* (collectively referred to as the spokes 120) can be connected and such that the hub 118 can support the spokes 120 and therefore the lamp shade. The hub 118 can be generally cylindrical and can define a bore 134 extending therethrough. The hub 118 can be other shapes in other examples, such as a rectangular prism, hexagonal prism, or the like. The spokes 120*a*-120*d* can extend radially or laterally outward from the hub 118 and can connect to a portion of the lamp shade. The spokes 120 can be cylindrical, but can be other shapes in other examples, such as a rectangular prism, hexagonal prism, octagonal prism, or the like.

The bearing 114 can be a bearing creating an articulation surface (or bearing surface) 126. In some examples the bearing 114 can be made of a material with a relatively low friction, such as polished plastics, metals, or the like. The flat surface 124 can be a relatively flat or planar surface of the bearing engageable with the mounting surface 122 of the bracket 108. In other examples, the flat surface 124 can be other shapes complimentary to the mounting bracket, such as curved or angled. The bearing surface 126 can be a curved shaped surface or a semi-spherical shaped surface, but can be other shapes in other examples. The bearing surface 126 can be configured to engage and support the hub 118 such that the hub 118 can articulate on the bearing surface 126.

The bearing bore 128 can extend through the bearing 114 and can be configured to receive the stud extension 116 and the stud 110 therethrough. In some examples, the bearing bore 128 can have a diameter D1 that can be larger than an outer diameter D2 of the female portion 132 of the stud extension 116.

In assembly of some examples, as discussed in further detail below, the bearing 214 can be positioned over the stud 110 by inserting the stud through the bearing bore 128. The female portion 132 of the stud extension 116 can be inserted through the bearing bore 128 and can be secured to the stud 110, such as through a threaded engagement. In other examples, the stud 110 can be secured to the stud extension 116, such as by using a screw, pin, interference fit, adhesive, or other fastener. In some examples, the stud extension 116 can be secured to the stud 110 before the bearing 114 is positioned around the stud 110. When the stud extension 116 is secured to the stud 110, the male portion 130 can extend above or beyond the bearing surface 126 of the bearing 114. The hub 118 can then be positioned over the stud extension 116 such that the stud extension 116 extends through the bore 134 of the stud extension and such that a bottom portion of the hub 118 engages the bearing surface 126 of the bearing 114. The male portion 130 of the stud extension 116 can extend above or beyond the top portion of the hub 118 when the hub 118 engages the bearing 114.

Engagement of the hub 118 with the bearing surface 126 of the bearing 114 can provide an articulation surface for the hub 118 such that the fitter 112 can be positioned at many orientations with respect to the bracket 108. As discussed below, when a desired orientation of the fitter 112 with respect to the bracket 108 (such as a level position of the lamp shade) is achieved, a finial can be secured to the stud extension 116 to engage the hub 118 and trap the hub 118 between the bearing 114 and the finial, helping to limit relative movement of the hub 118 (and therefore the fitter 112 and the lamp shade) with respect to the bracket 108 (and therefore with respect to the harp 106 and the base of the lamp).

In some examples, weights can be secured to the spokes 120*a*-120*d* to aid in achieving a desired orientation of the shade. In some examples, the finial may not engage the hub 118 such that the hub 118 is free to articulate on the bearing 114, allowing the weights to re-center the shade if the shade is moved or bumped.

Figure 2C:
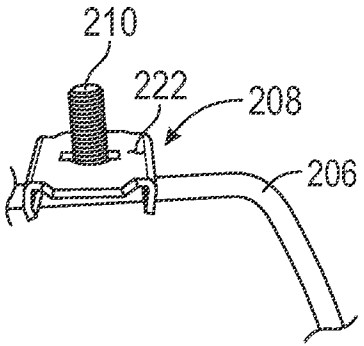
FIG. 2C illustrates a top perspective view of a portion of a lamp shade leveling assembly.
Figure 2B:
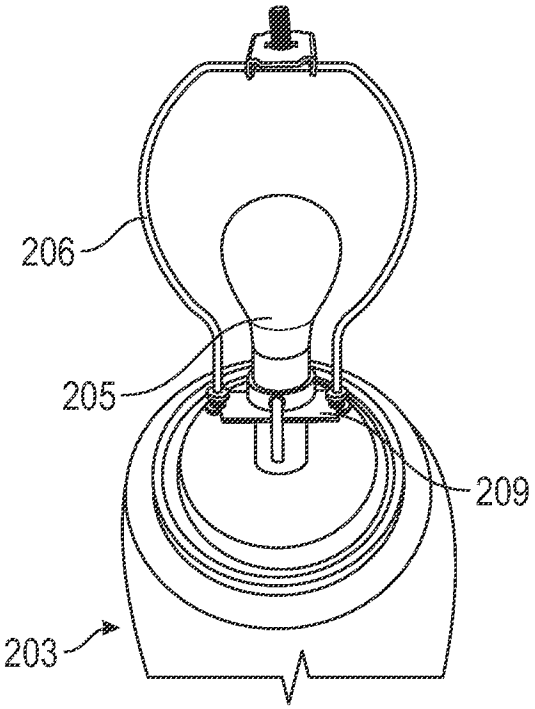
FIG. 2B illustrates a top perspective view of a portion of a lamp shade leveling assembly.
Figure 2A:
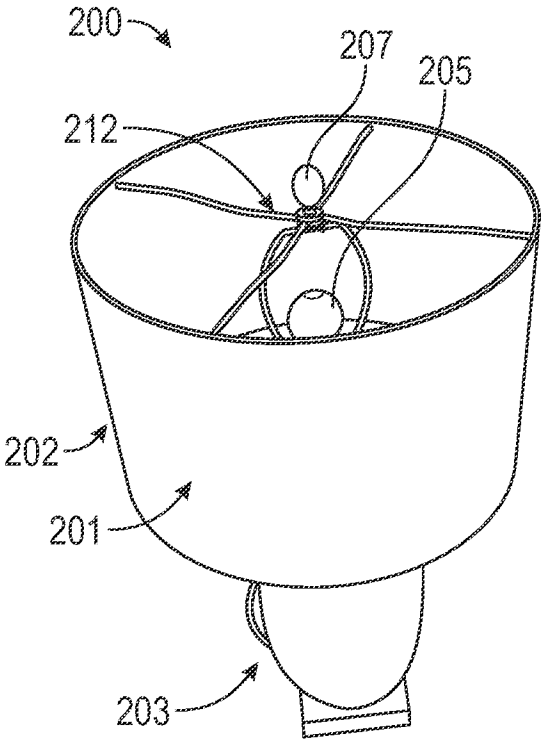
FIG. 2A illustrates a top perspective view of a lamp.

FIG. 2A illustrates a top perspective view of a lamp shade leveling assembly 200, in accordance with at least one example of this disclosure. The lamp shade leveling assembly 200 of FIGS. 2A-2K can be similar to the lamp shade leveling assembly 100 discussed above with respect to FIG. 1. FIGS. 2A-2K show how the lamp shade leveling assembly 200 can be used.

For example, FIG. 2A shows that a lamp 202 of the lamp shade leveling assembly 200 can be provided that includes a lamp shade 201 connected to a fitter 212. FIG. 2A also shows a base 203 that can support the shade 201 and a light bulb 205. FIG. 2A also shows a finial 207 secured to a post or stud of the lamp 202.

FIG. 2B illustrates a top perspective view of a portion of the lamp shade leveling assembly 200. FIG. 2B shows that the finial 207 (of FIG. 2A) can be removed and the lamp shade 201 can be removed from the harp 206. FIG. 2B also shows that the harp 206 can be connected to a saddle bracket 209, which can be secured to the base 203.

FIG. 2C illustrates a top perspective view of a portion of the lamp 201 and the lamp shade leveling assembly 200. FIG. 2C shows the stud 210 extending from the mounting surface 222 of the bracket 208.

Figure 2D:
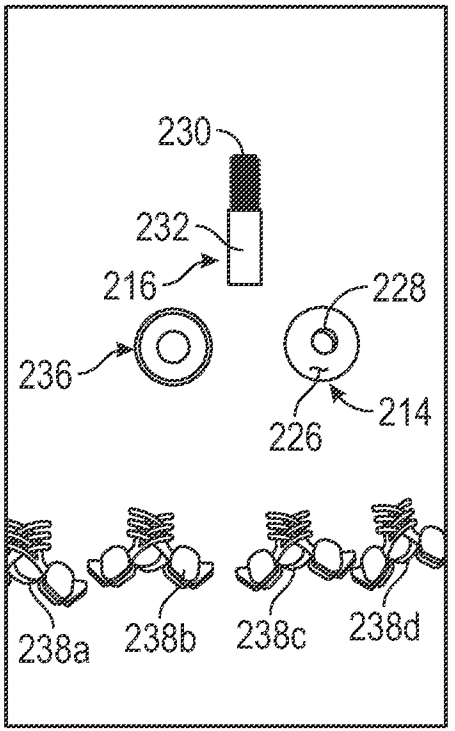
FIG. 2D illustrates a top view of components of the lamp shade leveling assembly.

FIG. 2D illustrates a top view of components of the lamp shade leveling assembly 200. FIG. 2D shows that the assembly 200 can include a level 236, which can be a bull's eye level, but can be other types of levels. The assembly 200 can also include weights 238*a*-238*d*, which can be configured to be releasably securable to the spokes 220*a*-220*d*.

Figure 2E:
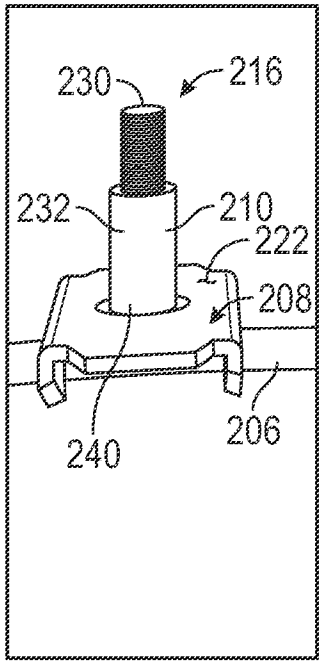
FIG. 2E illustrates a top perspective view of a portion of a lamp shade leveling assembly.

FIG. 2E illustrates a top perspective view of a portion of the lamp shade leveling assembly 200. FIG. 2E shows how a threaded bore 240 of the female portion 232 of the stud extension 216 can receive, and can be threadably engaged with, the stud 210 such that a bottom portion of the stud extension 216 engages the mounting surface 222 of the bracket 208, where the bracket 208 and the stud extension 216 can be supported by the harp 206. FIG. 2E also shows that the male portion 230 of the stud extension 216 can extend upward and away from the bracket 208.

Figure 2F:
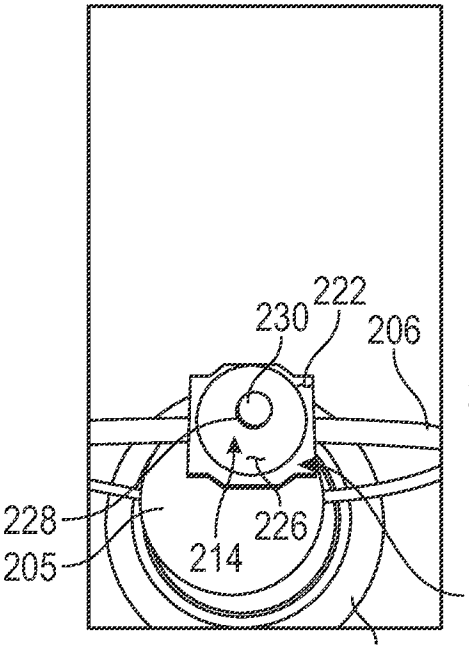
FIG. 2F illustrates a top view of a portion of a lamp shade leveling assembly.

FIG. 2F illustrates a top view of a portion the lamp shade leveling assembly 200. FIG. 2F shows that the bearing 214 can be positioned over the stud 210 (and the stud extension 216) of the lamp shade assembly 200 such that the bearing 214 engages the bracket 208 of the lamp shade assembly 200 and such that the male portion 230 of the stud extension 216 extends through the bore 228 of the bearing and extends beyond the bearing surface 226 when the bearing 214 engages the bracket 208.

Figure 2G:
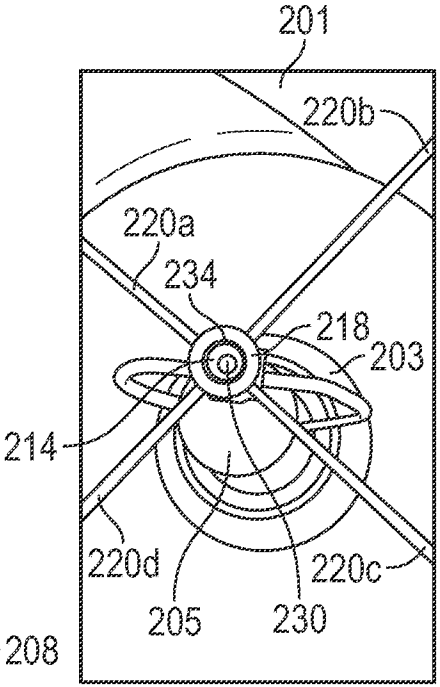
FIG. 2G illustrates a top perspective view of a portion of a lamp shade leveling assembly.

FIG. 2G illustrates a top perspective view of a portion of the lamp shade leveling assembly 200. FIG. 2G shows that the hub 218 can be positioned such that the hub 218 engages the bearing surface 226 of the bearing 214 to provide an articulation surface for the hub 218. In some examples, the male portion 230 of the stud extension 216 can extend through a bore 234 of the hub 218 and can extend beyond or above the hub 218.

Figure 2I:
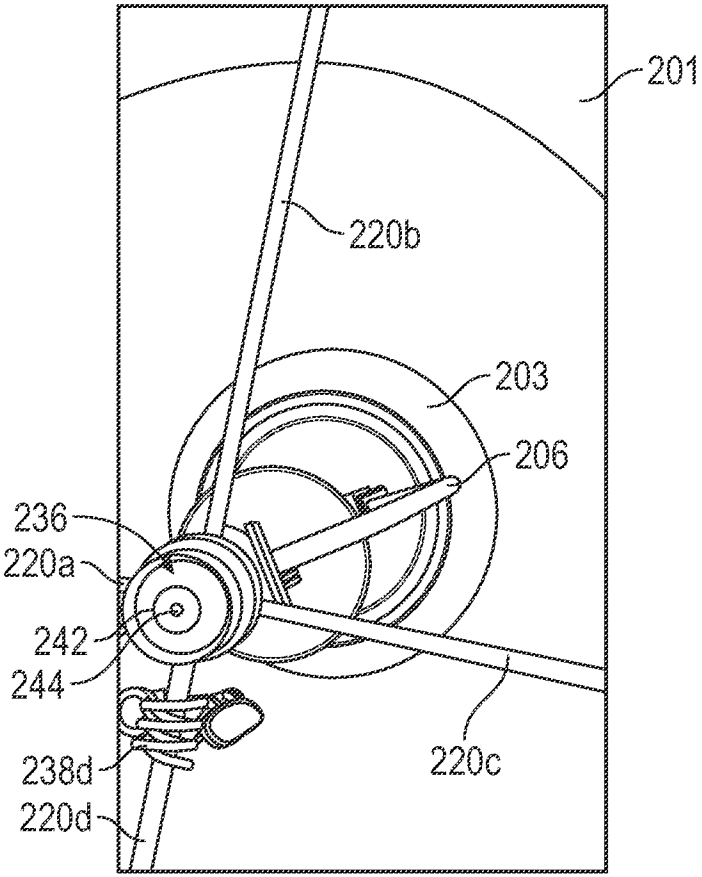
FIG. 2I illustrates a top perspective view of a portion of a lamp shade leveling assembly.
Figure 2H:
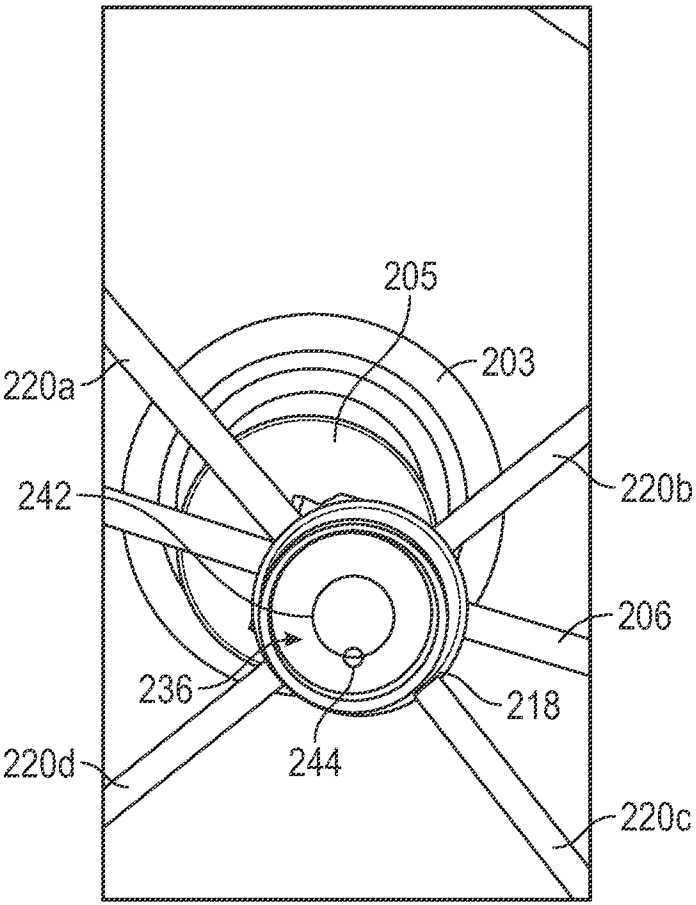
FIG. 2H illustrates a top perspective view of a portion of a lamp shade leveling assembly.

FIG. 2H illustrates a top perspective view of a portion of the lamp shade leveling assembly 200. FIG. 2I illustrates a top perspective view of a portion of the lamp of the lamp shade leveling assembly 200, in accordance with at least one example of this disclosure. FIGS. 2H and 2 are discussed below concurrently.

FIGS. 2H and 2I shows that the level 236 can be positioned on the hub 218. In some examples, the level 236 can include a magnet to couple the level 236 to the hub 218. In other examples, the level 236 can included a threaded portion to secure the level 236 to the stud extension 216.

FIGS. 2H and 2I also show that the level can include a reference indicator 242, which can be a ring, dot, or other indicia. FIGS. 2H and 2I also show a bubble 244 within fluid (such as a spirit) of the level 236. FIG. 2H shows that the bubble 244 can be off-center, as indicated by a position of the bubble 244 with respect to the indicator 242. At this point, the lamp shade 201 can be adjusted (by articulating the hub 218 on the bearing 214) so that the hub 218 is level or such that the bubble 244 is positioned at a center of the indicator 242 or is positioned as desired.

During or after these steps, the weights 238 can be connected to the spokes 220. Once connected to the spokes 220, the weights 238*a*-238*d* can be positioned along the spokes 220*a*-220*d*, respectively, which can cause the hub 218 to move on the bearing surface 226. The weights 238*a*-228*d* can be positioned on the spokes 220*a*-220*d*, respectively, until the lamp shade 201 is oriented in the level position, until the bubble 244 is centered with respect to the indicator 242, or until the bubble 244 is oriented as desired.

Figure 2K:
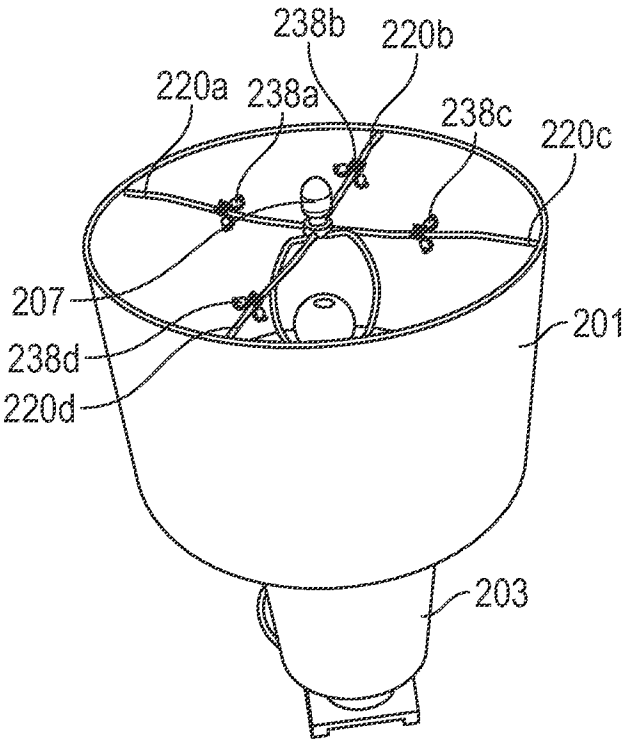
FIG. 2K illustrates a top perspective view of a portion of a lamp shade leveling assembly.
Figure 2J:
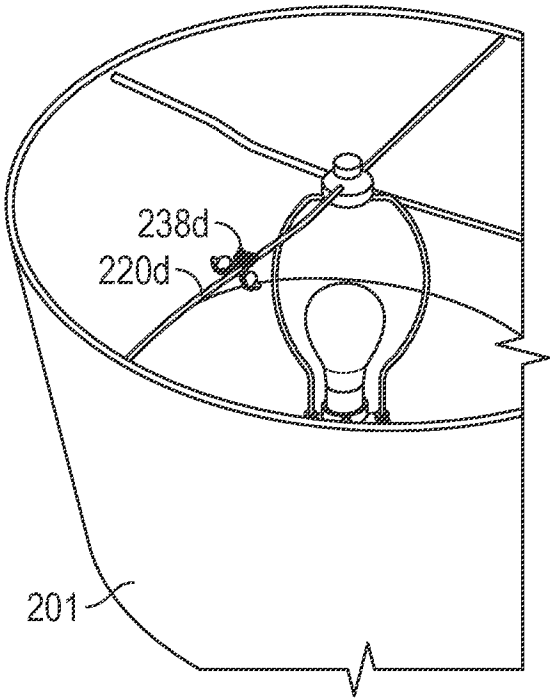
FIG. 2J illustrates a top perspective view of a portion of a lamp shade leveling assembly.

FIG. 2J illustrates a top perspective view of a portion of the lamp shade leveling assembly 200, in accordance with at least one example of this disclosure. FIG. 2J shows that the weight 238*d* can be positioned on the spoke 220*d*. In some examples, one or more of the weights 238 can be positionable along a length of any of the spokes 220 to achieve a desired orientation of the lamp shade 201 with respect to the base 203.

FIG. 2K illustrates a top perspective view of a portion of the lamp shade leveling assembly 200. FIG. 2K shows that the finial 207 can be secured to the male thread portion 230 of the stud extension 216 such that the finial 207 can engage the hub 218 to help limit movement of the hub 218 with respect to the bracket 208, which can maintain the desired position of the lampshade 201 that was obtained through the leveling process discussed in FIGS. 2A-2J.

Figure 3B:
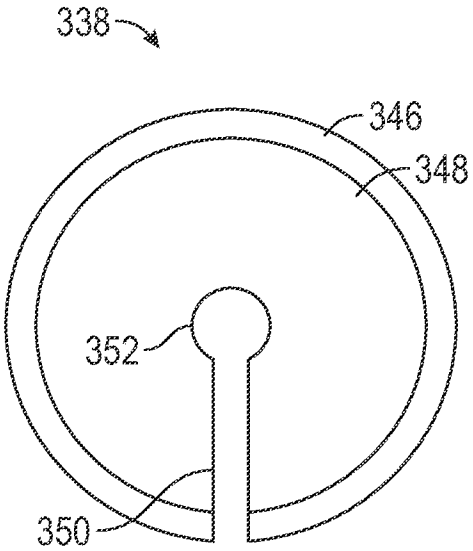
FIG. 3B illustrates an end view of a weight of a lamp shade leveling assembly.
Figure 3A:
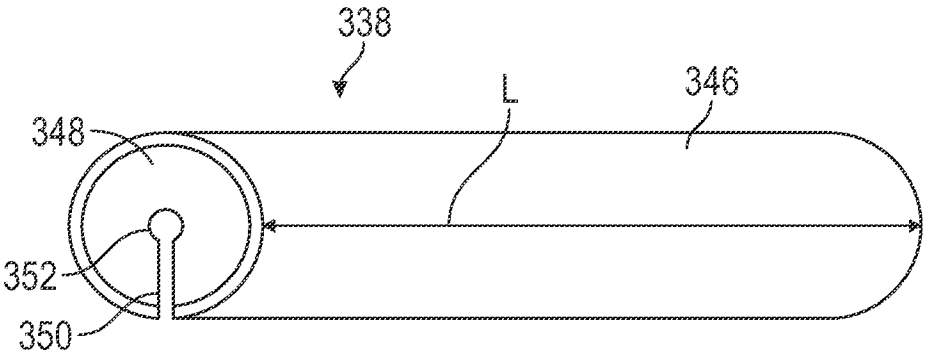
FIG. 3A illustrates a side isometric view of a weight of a lamp shade leveling assembly.

FIG. 3A illustrates a side isometric view of a weight 300 of a lamp shade leveling assembly, in accordance with at least one example of this disclosure. FIG. 3B illustrates an end view of the weight 300 of a lamp shade leveling assembly. FIGS. 3A and 3B are discussed below concurrently.

The weight 300 can include a liner (or outer portion) 346 a body 348 (or inner portion). The liner 346 and the body 348 can together define a slit 350 that can extend through the liner 346 and into the body 348 and can terminate in the body 348, such as near a center of the body 348. In some examples, the slit 350 can connect to a bore 352 near a center of the body 348. The bore 352 can be cylindrical, but can be other shapes complimentary to the spoke 320, such as octagonal, rectangular, hexagonal, or the like.

The liner 346, the body 348, or both together can form a cylindrical or substantially cylindrical shape, but can have other shapes in other examples, such as a rectangular prism, a hexagonal prism, an octagonal prism, or the like. The slit 350 can be an opening that can extend along an entirety of an axial length L of the weight 338. The slit 350 can extend from an outer surface of the liner 346 radially into the body 348 and can terminate within the weight 338. The slit 350 can be configured to receive a spoke, such as the spoke 220*a*, therein to secure the weight 338 to the spoke.

The body 348 can be configured to engage a spoke to help limit movement of the weight 338 with respect to the spoke. In some examples, the body 348 can be made of a high friction material such as a rubber, plastic, or the like. In some of these examples, the liner 346 can be made of a relatively rigid material or a relatively reflective material to help emit light from the lamp, such as metal, polished material, or the like.

Figure 3E:
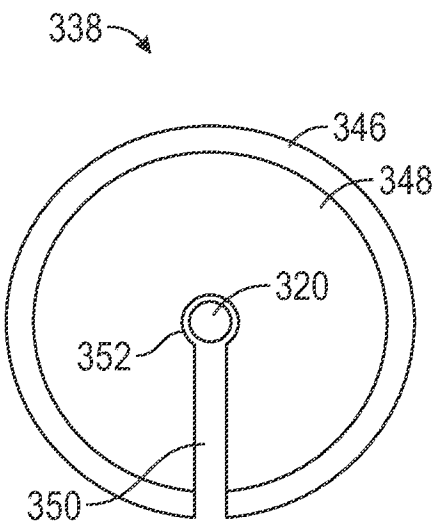
FIG. 3E illustrates an end view of a weight of a lamp shade leveling assembly in a third condition.
Figure 3D:
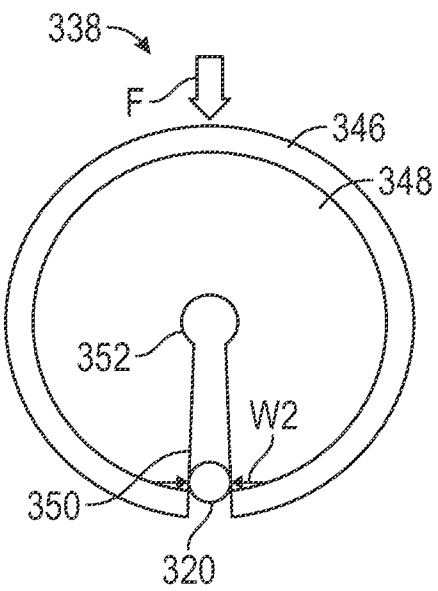
FIG. 3D illustrates an end view of a weight of a lamp shade leveling assembly in a second condition.
Figure 3C:
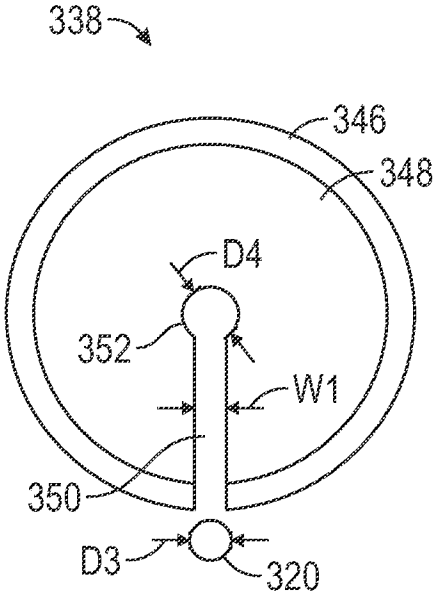
FIG. 3C illustrates an end view of a weight of a lamp shade leveling assembly in a first condition.

FIG. 3C illustrates an end view of the weight 338 of a lamp shade leveling assembly in a first condition, in accordance with at least one example of this disclosure. FIG. 3D illustrates an end view of the weight 338 of a lamp shade leveling assembly in a second condition. FIG. 3E illustrates an end view of the weight 338 of a lamp shade leveling assembly in a third condition. FIGS. 3C-3E are discussed below concurrently.

As shown in FIG. 3C, the slit 350 can define a width W1 which can be larger than a diameter D3 of the spoke 320. Because the body 348 can be flexible (as can the liner 346 in some examples), the spoke 320 can be forced, such as by applying a force F, as shown in FIG. 3D, to the weight 338 to move the spoke 320 into the slit 350. The force F can cause the slit 350 to expand to a width W2, as shown in FIG. 3D, where the width W2 is larger than the diameter D3 of the spoke 320. In some examples, the body 348 can elastically deform between the width Wi and the width W2 of the slit 350 to receive the spoke 320. The force F can be applied until the spoke reaches the bore 352, as shown in FIG. 3E. The bore 352 can have a diameter D4 that is larger than the diameter D3 of the spoke 320 such that the spoke can rest in the bore 352. In other examples, the diameter D4 can be smaller than the diameter D3.

The body 348 can be configured such that the force F required to move the spoke 320 through the slit 350 is larger than a gravitational force. This can allow the spoke 320, when positioned within the bore 352, to remain within the bore 352 and to not pass through the slit 350 due to the force of gravity, which can help allow the weight 338 to remain connected to the spoke 320 until it is desired to remove the weight 338 from the spoke 320.

In some examples, the diameter D4 can be similarly sized to the diameter D3 such that there is some engagement between the spoke 320 and the body 348 when the spoke 320 is positioned within the bore 352, which can help the weight 338 to resist movement along a length of the spoke 320 when the weight 338 is secured to the spoke. However, the bore 352 can be sized such that the resistance can be easily overcome to reposition the weight 338 as desired along the length of the spoke 320. In some examples where the outer liner 346 is rigid, the outer liner 346 can have an opening larger than the diameter D3 of the spoke and the width W1 can be smaller than the opening in the outer liner 346.

Figure 4B:
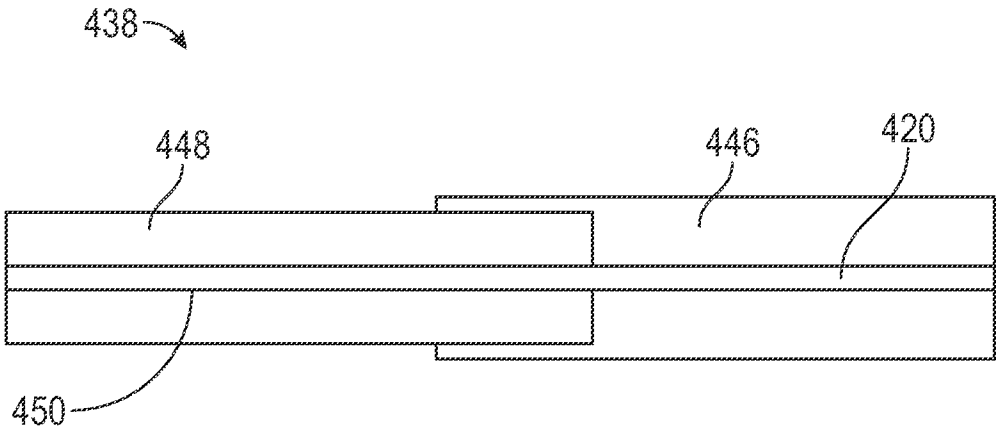
FIG. 4B illustrates an end view of a weight of a lamp shade leveling assembly in a second condition.
Figure 4A:
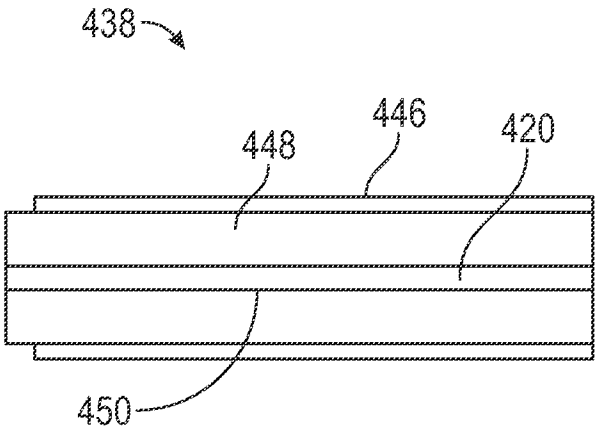
FIG. 4A illustrates an end view of a weight of a lamp shade leveling assembly in a first condition.

FIG. 4A illustrates an end view of a weight 438 of a lamp shade leveling assembly in a first condition, in accordance with at least one example of this disclosure. FIG. 4B illustrates an end view of the weight 438 of a lamp shade leveling assembly in a second condition, in accordance with at least one example of this disclosure. FIGS. 4A-4B are discussed below concurrently.

The weight 438 can include an outer portion 446 and an inner portion 448 where the inner portion 448 can define a slit 450. Also shown in FIGS. 4A and 4B is a spoke 420. The weight 438 can be similar to the weights discussed above, except that the inner portion 448 can be movable with respect to the outer portion 446. In some examples, the outer sleeve portion 446 can translate, or move telescopically, with respect to the inner sleeve portion 448.

For example, the inner sleeve portion 448 can receive the spoke 420 therein (in a manner similar to the inner sleeve portion 348 discussed above). The outer sleeve portion 446 can be made of a relatively heavy material, such as steel. Then, when the spoke 420 is within the inner sleeve portion 448, the outer sleeve portion 446 can be translated relative to the inner sleeve portion 448 and the spoke 420, to adjust a center of mass of the weight 438 with respect to the spoke, which can allow a user to adjust the weight 438 on the spoke 420 without moving the weight 438. In some examples, the outer portion 446 can translate in either direction along the length of the weight 438 or spoke 420.

NOTES AND EXAMPLES

The following, non-limiting examples, detail certain aspects of the present subject matter to solve the challenges and provide the benefits discussed herein, among others.

Example 1 is a leveling system for a lamp shade, the system comprising: a bearing positionable around a stud of a lamp shade assembly and configured to be supported by a bracket of the lamp shade assembly, the bearing defining a bearing surface engageable with a hub of the lamp shade to provide an articulation surface for the hub; a stud extension comprising: a female threaded portion securable to the stud of the lamp shade assembly; and a male threaded portion configured to extend beyond the bearing surface when the bearing is supported by the bracket, the male threaded portion couplable to a finial; and a weight releasably securable to a spoke of the lamp shade and positionable on the spoke to level the lamp shade about the bearing with respect to a plane.

In Example 2, the subject matter of Example 1 optionally includes a second weight securable to a second spoke of the lamp shade and positionable on the second spoke to level the lamp shade about the bearing with respect to a second plane.

In Example 3, the subject matter of any one or more of Examples 1-2 optionally include wherein the bearing surface defines a semi-spherical shape.

In Example 4, the subject matter of any one or more of Examples 1-3 optionally include wherein the bearing surface is a curved surface.

In Example 5, the subject matter of any one or more of Examples 1-4 optionally include wherein the bearing includes a bottom portion defining a substantially flat surface configured to engage a flat surface of the bracket of the lamp shade assembly.

In Example 6, the subject matter of any one or more of Examples 1-5 optionally include wherein the weight has a substantially cylindrical shape and includes a slit extending along an entirety of an axial length of the weight, the slit configured to receive the spoke to secure the weight to the spoke.

In Example 7, the subject matter of Example 6 optionally includes wherein the slit extends from an outer surface of the weight radially into the weight and terminates within the weight.

In Example 8, the subject matter of Example 7 optionally includes wherein the weight includes an outer liner and an inner portion configured to engage the spoke to limit movement of the weight with respect to the spoke.

In Example 9, the subject matter of Example 8 optionally includes wherein the outer liner is comprised of a metal and the inner portion is comprised of a rubber.

In Example 10, the subject matter of any one or more of Examples 6-9 optionally include wherein the weight includes a first sleeve portion and a second sleeve portion, the first sleeve portion configured to move telescopically with respect to the second sleeve portion.

In Example 11, the subject matter of any one or more of Examples 6-10 optionally include wherein the slit defines a width that is smaller than a diameter of the spoke and wherein the weight is configured to elastically deform to receive the spoke therein.

In Example 12, the subject matter of any one or more of Examples 1-11 optionally include wherein the bearing defines a bore extending therethrough, the bore defining a bore diameter, and wherein the female portion of the stud extension defines a stud diameter that is smaller than the bore diameter.

Example 13 is a leveling system for a lamp shade, the system comprising: a bearing positionable around a stud of a lamp shade assembly and configured to be supported by a bracket of the lamp shade assembly, the bearing defining a bearing surface engageable with a hub of the lamp shade to provide an articulation surface for the hub; a stud extension comprising: a female threaded portion securable to the stud of the lamp shade assembly; and a male threaded portion configured to extend beyond the bearing surface when the bearing is supported by the bracket, the male threaded portion couplable to a finial; and a plurality of weights releasably securable to a plurality of spokes of the lamp shade, each weight positionable on one of the spokes to level the lamp shade about the bearing.

In Example 14, the subject matter of Example 13 optionally includes wherein each weight is positionable along a length of any of the spokes.

In Example 15, the subject matter of Example 14 optionally includes wherein each weight is configured to resist movement along the length of the spoke when the weight is secured to the spoke.

In Example 16, the subject matter of any one or more of Examples 13-15 optionally include wherein the bearing surface is a curved surface and wherein the bearing includes a bottom portion defining a substantially flat surface configured to engage a flat surface of the bracket of the lamp shade assembly.

In Example 17, the subject matter of Example 16 optionally includes wherein each of the weights has a substantially cylindrical shape and includes a slit extending along an entirety of an axial length of the weights, the slit extends from an outer surface of the weight radially into the weight and terminates within the weight, and the slit configured to receive the spoke to secure the weight to the spoke.

In Example 18, the subject matter of Example 17 optionally includes wherein the weight includes an outer liner and an inner portion configured to engage the spoke to prevent movement of the weight with respect to the spoke.

In Example 19, the subject matter of any one or more of Examples 13-18 optionally include a bull's eye level positionable on a hub of the lamp shade to determine an orientation of the lamp shade with respect to a level position.

Example 20 is a method of leveling a lamp shade, the method comprising: securing a female threaded portion of a stud extension to a stud of a lamp shade assembly; positioning a bearing over the stud of the lamp shade assembly such that the bearing engages a bracket of the lamp shade assembly and such that a male threaded portion of the stud extension extends beyond the bearing when the bearing engages the bracket; engaging a bearing surface of the bearing with a hub of the lamp shade to provide an articulation surface for the hub; releasably securing a plurality of weights to a plurality of spokes of the lamp shade; and positioning each weight on its spoke, respectively, to level the lamp shade about the bearing.

In Example 21, the subject matter of Example 20 optionally includes positioning a bull's eye level on a hub of the lamp shade to determine an orientation of the lamp shade with respect to a level position.

In Example 22, the subject matter of Example 21 optionally includes adjusting a position of one or more of the weights on its respective spoke to orient the lamp shade in the level position.

In Example 23, the subject matter of any one or more of Examples 20-22 optionally include securing a finial to the male thread portion to secure the hub.

Example 24 is a leveling system for a lamp shade, the system comprising: a bearing positionable around a stud of a lamp shade assembly and configured to be supported by a bracket of the lamp shade assembly, the bearing defining a bearing surface engageable with a hub of the lamp shade to provide an articulation surface for the hub; a weight releasably securable to a spoke of the lamp shade and positionable on the spoke to level the lamp shade about the bearing with respect to a level position.

In Example 25, the apparatuses or method of any one or any combination of Examples 1-24 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A leveling system for a lamp shade, the system comprising:

a bearing positionable around a stud of a lamp shade assembly and configured to be supported by a bracket of the lamp shade assembly, the bearing defining a bearing surface engageable with a hub of the lamp shade to provide an articulation surface for the hub;

a stud extension comprising:

a female threaded portion securable to the stud of the lamp shade assembly; and a male threaded portion configured to extend beyond the bearing surface when the bearing is supported by the bracket, the male threaded portion couplable to a finial; and a weight releasably securable to a spoke of the lamp shade and positionable on the spoke to level the lamp shade about the bearing with respect to a plane.

2. The system of claim 1, further comprising:

a second weight securable to a second spoke of the lamp shade and positionable on the second spoke to level the lamp shade about the bearing with respect to a second plane.

3. The system of claim 1, wherein the bearing surface defines a semi-spherical shape.

4. The system of claim 1, wherein the bearing surface is a curved surface.

5. The system of claim 1, wherein the bearing includes a bottom portion defining a substantially flat surface configured to engage a flat surface of the bracket of the lamp shade assembly.

6. The system of claim 1, wherein the weight has a cylindrical shape and includes a slit extending along an entirety of an axial length of the weight, the slit configured to receive the spoke to secure the weight to the spoke.

7. The system of claim 6, wherein the slit extends from an outer surface of the weight radially into the weight and terminates within the weight.

8. The system of claim 7, wherein the weight includes an outer liner and an inner portion configured to engage the spoke to limit movement of the weight with respect to the spoke.

9. The system of claim 8, wherein the outer liner is comprised of a metal and the inner portion is comprised of a rubber.

10. The system of claim 6, wherein the weight includes a first sleeve portion and a second sleeve portion, the first sleeve portion configured to move telescopically with respect to the second sleeve portion.

11. The system of claim 6, wherein the slit defines a width that is smaller than a diameter of the spoke and wherein the weight is configured to elastically deform to receive the spoke therein.

12. The system of claim 1, wherein the bearing defines a bore extending therethrough, the bore defining a bore diameter, and wherein the female portion of the stud extension defines a stud diameter that is smaller than the bore diameter.

13. A leveling system for a lamp shade, the system comprising:

a bearing positionable around a stud of a lamp shade assembly and configured to be supported by a bracket of the lamp shade assembly, the bearing defining a bearing surface engageable with a hub of the lamp shade to provide an articulation surface for the hub;

a stud extension comprising:

a female threaded portion securable to the stud of the lamp shade assembly; and a male threaded portion configured to extend beyond the bearing surface when the bearing is supported by the bracket, the male threaded portion couplable to a finial; and a plurality of weights releasably securable to a plurality of spokes of the lamp shade, each weight positionable on one of the spokes to level the lamp shade about the bearing.

14. The system of claim 13, wherein each weight is positionable along a length of any of the spokes.

15. The system of claim 14, wherein each weight is configured to resist movement along the length of the spoke when the weight is secured to the spoke.

16. The system of claim 13, wherein the bearing surface is a curved surface and wherein the bearing includes a bottom portion defining a substantially flat surface configured to engage a flat surface of the bracket of the lamp shade assembly.

17. The system of claim 16, wherein each of the weights has a substantially cylindrical shape and includes a slit extending along an entirety of an axial length of the weights, the slit extends from an outer surface of the weight radially into the weight and terminates within the weight, and the slit configured to receive the spoke to secure the weight to the spoke.

18. The system of claim 17, wherein the weight includes an outer liner and an inner portion configured to engage the spoke to prevent movement of the weight with respect to the spoke.

19. The system of claim 13, further comprising:

a bull's eye level positionable on a hub of the lamp shade to determine an orientation of the lamp shade with respect to a level position.

20. A leveling system for a lamp shade, the system comprising:

a bearing positionable around a stud of a lamp shade assembly and configured to be supported by a bracket of the lamp shade assembly, the bearing defining a bearing surface engageable with a hub of the lamp shade to provide an articulation surface for the hub;

a weight releasably securable to a spoke of the lamp shade and positionable on the spoke to level the lamp shade about the bearing with respect to a level position.

* * * * *